US005108003A

United States Patent [19]

Granofsky

[11] Patent Number: 5,108,003

[45] Date of Patent: Apr. 28, 1992

[54] COVER FOR BEVERAGE CAN

[76] Inventor: Barry P. Granofsky, 7770-G Youngdale, Stanton, Calif. 90680

[21] Appl. No.: 712,494

[22] Filed: Jun. 10, 1991

[51] Int. Cl.[5] ..... B65D 51/20

[52] U.S. Cl. ..... 220/257; 220/269; 220/711

[58] Field of Search ..... 220/90.2, 90.4, 90.6, 220/255, 257, 260, 269

[56] References Cited

U.S. PATENT DOCUMENTS

| | | | |
|---|---|---|---|
| 3,204,805 | 9/1965 | May | 220/257 |
| 3,269,586 | 8/1966 | Quimay et al. . | |
| 3,335,893 | 8/1967 | Hanson . | |
| 3,362,563 | 1/1968 | Koll . | |
| 3,362,572 | 1/1968 | Pelley | 220/270 |
| 3,690,509 | 9/1972 | Kinoian et al. | 220/90.6 |
| 3,785,519 | 1/1974 | Huh . | |
| 4,493,431 | 1/1985 | Cho | 220/269 |
| 4,520,942 | 6/1985 | Dwinell | 220/257 |
| 4,893,725 | 1/1990 | Ball et al. | 220/269 |
| 4,895,270 | 1/1990 | Main et al. | 220/257 |
| 4,927,048 | 5/1990 | Howard | 220/90.2 |

*Primary Examiner*—Gary E. Elkins
*Assistant Examiner*—Nova Stucker
*Attorney, Agent, or Firm*—Richard F. Carr; Richard L. Gausewitz; Allan Rothenberg

[57] ABSTRACT

A sanitary can cover is provided which extends over the top portion of a beverage can and includes a severable strip along its lower edge which allows the cover to be peeled back so that the can may be opened. Only about half of the cover can be folded away from the end of the can, the remainder of the cover being adhesively secured to the can. The cover may include a plug sealing an opening in the end wall of the can, and a pull tab to assist in removing the plug from the opening.

10 Claims, 2 Drawing Sheets

COVER FOR BEVERAGE CAN

BACKGROUND OF THE INVENTION

Beverage cans, such as for soft drinks, beer, juices, and the like, are marketed without any covering over the end of the can which subsequently is opened. The familiar six-pack leaves the can ends exposed for the most part, and provide no assurance of sanitation. Nevertheless, the consumer commonly drinks directly from such beverage cans running the risk of contracting a contagious disease. Even when the beverage is decanted into another vessel, the end of the can seldom is cleansed before this is done. Thus, ordinary beverage cans present a health hazard that generally is not even perceived by the consuming public. A need has existed for correcting this situation.

SUMMARY OF THE INVENTION

The present invention provides a sanitary can cover that gives absolute protection against contamination of the end of the can. The cover remains with the can even when the can is opened so that it does not present a litter problem. Moreover, the cover may be recycled along with the can hence being advantageous environmentally The means for forming an opening in the can may be incorporated in the cover, i.e., a plug may be associated with the cover and removed from an opening in the end of the can when the cover is partially removed from the can end. Alternatively, the cover may be used with a conventional means for forming an opening in a can, such as a lever opener or an adhesive membrane that seals an aperture in the can. When the closure is incorporated in the cover, the closure may be returned to the opening in the can to reseal it. The cover is easy to use and economical in manufacture.

The can cover of this invention circumscribes the tapered top shoulder of the beverage can and extends entirely across the radial end wall of the can. A portion of the cover extends over the cylindrical wall of the can adjacent the tapered shoulder. About half of the closure, at the juncture of these two sections, has a frangible area so that a strip of the cover may be pulled free. This allows the cover to be folded away from the can, exposing the area of the can opening. However, other portions of the cover are adhesively secured to the can so that it can be only partially removed from the can. In other words, the cover can be folded back to expose the area of the opening to allow the can to be drunk from or the beverage decanted, yet the cover will not become separated from the can, avoiding litter. Of course, before the cover is applied to the can, the end of the can is sanitized such as by exposing it to steam.

DETAILED DESCRIPTION OF THE INVENTION

Figure 1:
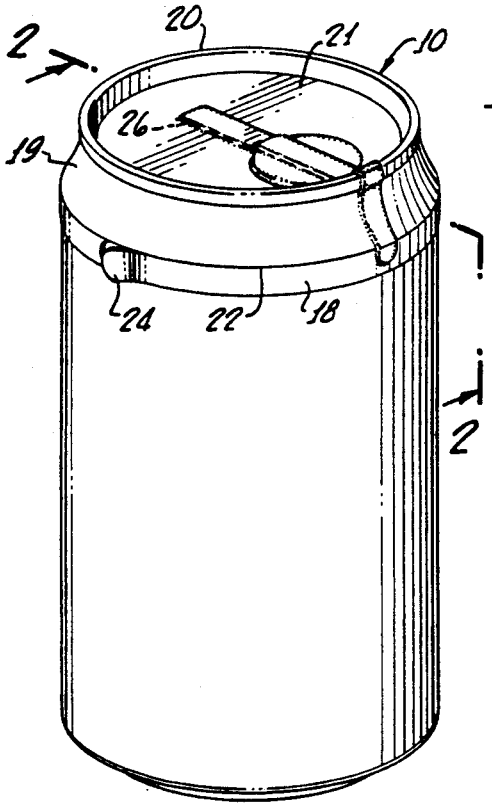
FIG. 1 is a perspective view of a beverage can incorporating the sanitary cover of this invention.
Figure 2:
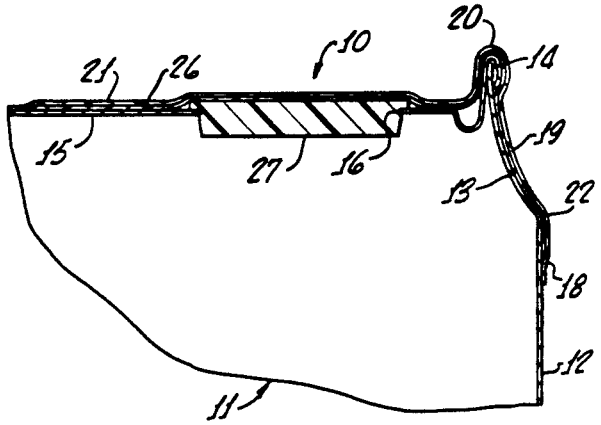
FIG. 2 is an enlarged fragmentary sectional view taken along line 2—2 of FIG. 1.

The can cover and seal 10 of this invention is illustrated in FIGS. 1 through 4 in association with a beverage can 11. This can, conventional in most respects, includes a cylindrical side wall 12 that connects to a tapered upper side wall 13. Circumscribing the upper end of the can 11 is a bead 14 which connects to a radial upper end wall 15. Instead of a conventional lever arrangement for forming an opening in the end wall of the can, a circular opening 16 is formed in the end wall 15. The opening 16 is off center, being close to one edge of the end wall 15.

The cover 10 is a flexible sheet of material that entirely covers the upper end portion of the can 11 and is complementary to most of this part of the can. The cover includes a narrow cylindrical band 18 circumscribing the upper end of the cylindrical side wall 12 just below its juncture with the tapered section 13. The cover also includes a portion 19 that overlies the tapered portion 13 of the can, as well as a part 20 that extends over the bead 14. The cover 10 further is provided with a radial wall 21 that fits over radial wall 15 of the can. The entire cover unit 10 is made of a recyclable material, such as plastic coated aluminum.

Figure 3:
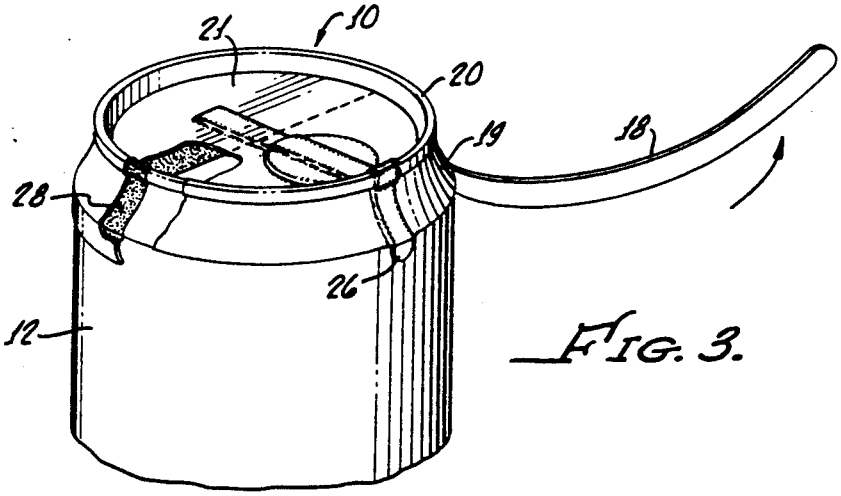
FIG. 3 is a fragmentary perspective view, partially broken away, illustrating the initial phase in the opening of the can.

A score 22 in the material of the cover 10 provides a weakened portion approximately along the juncture between the band 18 and the tapered portion 19 of the cover. This score extends about half-way around the cover with its center extending beneath the edge of the end wall 15 at the location of the opening 16. At one end of the score, the band 18 is severed to provide a loosened portion 24, as seen in FIG. 1. Therefore, the band 18 provides a strip that can be loosened from about the periphery of the wall 12 of the can, as shown in FIG. 3. However, the band 18 remains an integral part of the cover 10, separating only at the loosened portion 24 and along the circumferential score 22.

A pull tab 26 extends radially partway across the can 11 and is attached to the underside of the cover 10. The tab 26 includes an end which becomes exposed when the band 18 is stripped away from one side of the can. From there the tab extends over the tapered portion 13 of the can around the bead 14 and radially across the end wall 15. Secured to the underside of the tab 26 is a plug 27 which fits tightly in the opening 16 in the wall 15 of the can. This seals off the interior of the can so that the contents of the can cannot escape.

Figure 4:
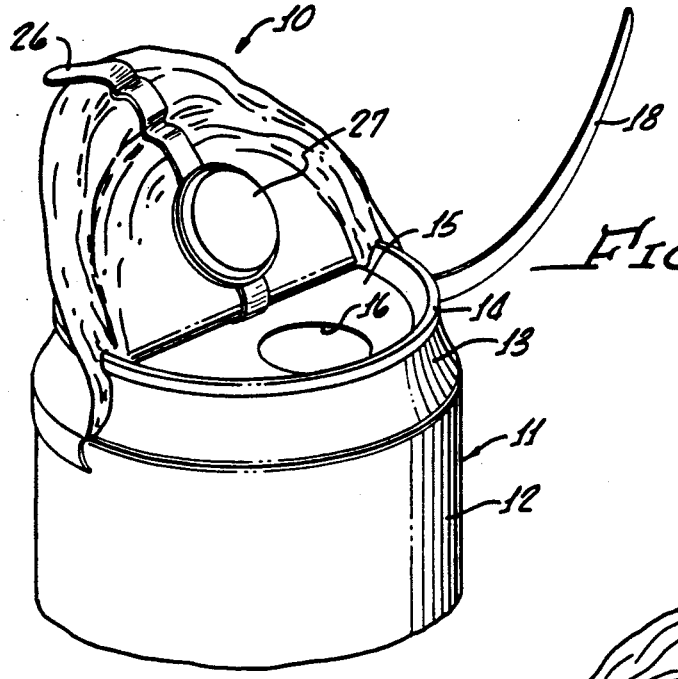
FIG. 4 is a fragmentary sectional view illustrating the can as opened.

Approximately half of the cover 10, including one end of the tab 26, is secured by an adhesive 28 to the periphery of the can 11. This includes the portion of the band 18 that does not separate from the can along the score 22. It also includes the portions 19, 20 and 21 of the cover approximately on one side of a diagonal extending across the cover from the ends of the score 22. The unattached portion of the cover 10 is adjacent the score 22 and extends over the plug 27. When the contents of the can 11 are to be consumed, the band 18 first is pulled free along the score 22 partway around the can, as shown in FIG. 3. Then the tab 26 is pulled upwardly causing the wall of the cover 10 to be removed from approximately half of the upper end of the can, as seen in FIG. 4. The material of the cover is not severed when this occurs but simply is rolled backwards.

This movement of the tab 26 also removes the plug 27 from the opening 16. Therefore, it is possible to drink directly from the can or pour the contents into another vessel. The cover 10 covers the entire upper end of the can until it is peeled back to the FIG. 4 position, which means that the can can be sanitized before the cover 10 is applied and a sanitary drinking surface will be assured.

Inasmuch as the cover 10 remains with the can 11 and does not become separated from it, the entire closure unit can be recycled with the can.

The opening 16 may be reclosed by pressing the plug 27 back into the opening. This reseals the can.

Figure 5:
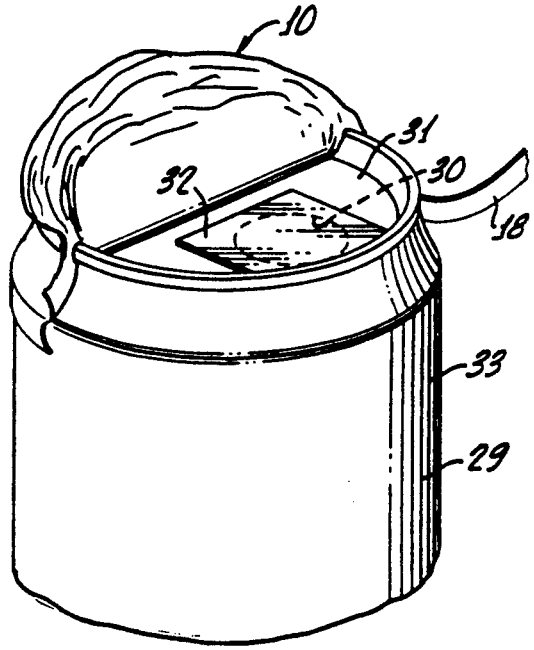
FIG. 5 is a fragmentary perspective view illustrating the can cover as used with a conventional closure for the can.

The embodiment of FIG. 5 provides a cover as before, but does not automatically open the can as the cover is peeled back. The can 29 of FIG. 5 includes an opening 30 through its upper end wall 31 which is closed by a thin plastic membrane 32 secured to the wall 31 by adhesive. This type of closure is common in some juice cans. As before, about half of the band 18 is separated from the cover along the score 22 when the can is to be opened. Inasmuch as it is not necessary to pull a plug from the opening 30 in the embodiment of FIG. 5, the pull tab 26 is unnecessary. After the band has been pulled loose, the cover is readily peeled back halfway to uncover the membrane 32 so that it can be removed and the contents of the can can be dispensed through the opening 30. As before, except for the approximately half of the can cover that is peeled back to uncover the opening, the remainder of the cover is adhesively secured to the can so that it will not be separated and littering is avoided. The can and cover are recyclable as one.

The cover 10 also may be used in conjunction with a can provided with a conventional lever-type opening arrangement.

The foregoing detailed description is to be clearly understood as given by way of illustration and example only, the spirit and scope of this invention being limited solely by the appended claims.

What is claimed is:

1. In combination with a beverage can having a side wall and a radial end wall, said end wall having means for forming an opening therethrough adjacent one edge thereof, a sanitary cover for said can comprising a flexible sheet member including a first annular part circumscribing said side wall adjacent said end wall, and a second part extending over all of said end wall, said member having a frangible segment overlying said side wall and extending circumferentially partway around said can past said one edge of said end wall, whereby a segment of said first portion of said flexible sheet member can be separated from said second part of said flexible sheet member so that a portion of said second part can be folded away from said end wall adjacent said one edge thereof to allow access to an opening formed in said end wall, said flexible sheet member at a location remote from said one edge of said end wall being adhesively secured to said can so that said flexible sheet member remains with said can when said second part thereof is so folded away from said end wall.

2. A device as recited in claim 1 in which said means for forming an opening in said end wall includes a plug sealingly received in an aperture in said end wall, said plug being attached to said flexible sheet member and removable from said aperture when said portion of said flexible sheet member is so folded away from said end wall.

3. A device as recited in claim 2 including tab means connected to said plug and positioned beneath said flexible sheet member for so removing said plug from said aperture.

4. A device as recited in claim 2 in which said plug is reinsertable in said aperture in said end wall after having been so removed therefrom.

5. In combination with a beverage can having a cylindrical wall, a tapered wall, one end of which connects to said cylindrical wall, an annular bead connected to the opposite end of said tapered wall and a radial end wall inwardly of said annular bead, said end wall having means for forming an opening therethrough adjacent one edge thereof, a sanitary cover for said can comprising a flexible sheet member including a first part circumscribing said cylindrical wall adjacent said tapered wall, and a second part circumscribing said tapered wall and said bead and extending over all of said end wall, said member having a frangible part extending circumferentially partway around said can substantially at the juncture between said cylindrical wall and said tapered wall, said frangible part extending past said one edge of said end wall, whereby an elongated segment of said first portion of said flexible sheet member can be separated from said second part of said flexible sheet member so that said second part can be folded away from said can to allow access to an opening formed in said end wall, said flexible sheet member at a location remote from said one edge of said radial end wall bein adhesively secured to said can so that said flexible sheet member remains with said can when said second part is so folded away from said end wall.

6. A device as recited in claim 5 in which said frangible segment extends approximately halfway around said can.

7. A device as recited in claim 6 in which one end of said elongated segment is severed so as to facilitate the grasping of said elongated segment.

8. A device as recited in claim 7 in which said flexible sheet member is so adhesively secured to said can at least at locations adjacent either end of said frangible part.

9. A device as recited in claim 5 in which for said means for forming an opening through said end wall an aperture is provided in said end wall, and a plug element is received in said aperture to seal the same, said plug element being movable with said flexible sheet member for removal from said opening.

10. A device as recited in claim 9 including a strip of material connected to said plug element, one end of said strip being adjacent said frangible part and unconnected to said can, the other end of said strip overlying said end wall remote from said edge thereof and being adhesively secured thereto, whereby said strip can be pulled for so folding said flexible member and so removing said plug from said opening yet said strip will remain attached to said can.

* * * * *